United States Patent [19]

Sinha

[11] Patent Number: 4,513,932

[45] Date of Patent: Apr. 30, 1985

[54] RIGID MULTI-CONE KITE

[76] Inventor: Betty B. Sinha, 482 Madison Ave., Toms River, N.J. 08753

[21] Appl. No.: 509,343

[22] Filed: Jun. 30, 1983

[51] Int. Cl.[3] ..... B64C 31/06

[52] U.S. Cl. ..... 244/153 R; D21/88; 446/61

[58] Field of Search ..... 244/153 R–155 A, 244/145, 152; 229/2.5 EC, 44 EC; 446/61, 488; D21/88

[56] References Cited

U.S. PATENT DOCUMENTS

| | | | |
|---|---|---|---|
| 1,734,493 | 11/1929 | Knott . | |
| 2,483,614 | 10/1949 | Benson . | |
| 2,520,704 | 8/1950 | Wisney . | |
| 3,152,782 | 10/1964 | Karpf | 244/145 |
| 3,237,895 | 3/1966 | Davies | 244/153 R |
| 3,362,605 | 1/1968 | Bixler | 229/2.5 EC |
| 3,451,577 | 6/1969 | Nurick | 229/2.5 EC |
| 3,494,578 | 2/1970 | Cureton | 244/153 |
| 3,563,446 | 2/1971 | Lake et al. | 229/2.5 EC |
| 3,809,342 | 5/1974 | Lemoigne | 244/145 |
| 3,860,204 | 1/1975 | Checkley | 244/153 R |
| 4,090,658 | 5/1978 | Fukuda | 229/2.5 EC |
| 4,389,032 | 6/1983 | Meckley | 244/153 R |

*Primary Examiner*—Galen L. Barefoot

*Attorney, Agent, or Firm*—Martha G. Pugh

[57] ABSTRACT

A kite comprising a central section and a pair of lateral sections of foam-like material, each section containing on its upper surface a pattern of cone-like protrusions with matching cutouts in each protrusion. The side sections are bent inwardly, forming equal internal angles with the upper surface of the central section. A movable flange is provided along the peripheral edge of each of the lateral sections. Strings are attached to the undersurface of the kite through holes in the flanges, and a tether is attached to these strings. The kite is further reinforced by string fastened to the tops and sides of the corner cones. Two tails are attached to provide stability.

9 Claims, 7 Drawing Figures

RIGID MULTI-CONE KITE

BACKGROUND OF THE INVENTION

This invention relates in general to kites and more particularly to kites formed of lightweight semi-rigid plastic material which are aerodynamically designed to have enhanced lift.

Kites of some of the types disclosed in the prior-art have air pockets and openings in the air pockets of various shapes and locations in order to accomplish various purposes, such as to provide lift and stability. Some of these air pockets are round, conical, or even cubical. In general, such air pockets are usually on the upper side of the kite.

However, certain types of prior-art kites have the disadvantage of being made of substances of low durability and/or high bendability or breakability, rendering them very susceptible to damage by the rigors of high winds. Furthermore, the shapes of certain types of prior-art kites are such as to disrupt the smooth flow of air currents. All of these factors tend to make these kites highly susceptible to damage or breakage, and often unstable in the air currents, thus inhibiting lift potential.

BRIEF DESCRIPTION OF THE INVENTION

Figure 1:
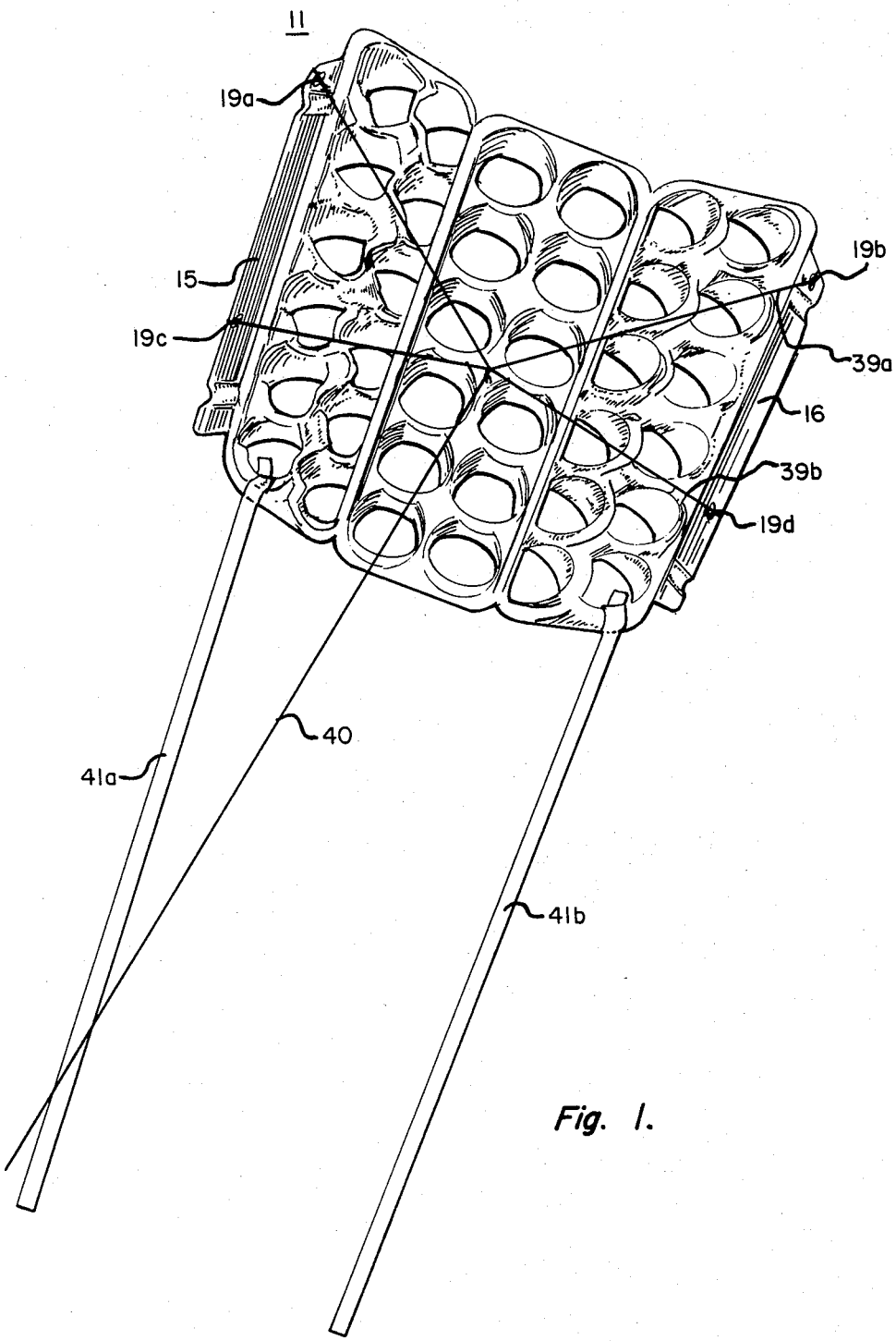
FIG. 1 is a front-perspective view of the underside of the rigid multi-cone kite.

Therefore, it is the general object of the invention to provide a kite having both greater lift and greater stability. More specific objects of the invention are to provide a kite that can fly at high altitudes while being more durable in the fact of optimal wind conditions for kite flying.

These and other objects are achieved in a multi-section kite of semi-rigid foam-like material, having a central section and a pair of lateral sections, each containing on its upper surface a pattern of hollow protrusions of frustoconical shape. The kite of the present invention comprises openings on the sidewalls of each of the frustoconical members, so as to form a plurality of air pockets. This location on the cone sidewalls operates to give the kite lift.

In accordance with a peferred embodiment of the invention, a kite is made of three die-stamped foam-like sections, with each section containing frustoconical protrusions. The sections are bonded together with quick-bonding cyanoacrylate glue, so that the long edges of the central section are connected to the inside long edges of the lateral sections so that the adjacent cones on the inner and outer sections touch each other. The side sections are bent inwardly to form substantially equal internal angles with the inner face of the central section. A particular feature of the invention is that the lower third of each cone is cut away to allow air to pass. In each cone the lower rim of the cutout area is a slight distance above the base of the cone, and parallel to it. Each of the cutout portions intersects the apex portion of the cone. The bases of the cones form rounded hollow projections that function aerodynamically. Hinged flanges extend laterally along the edges from each of the side sections. Strings are attached to the bottom of the kite through four perforations in the flanges, one pair of strings being attached near the front, and one pair of strings being attached near the rear of the respective flanges. A tether is tied to both strings and can be adjusted for stability. String is glued across the tops and down the sides of the corner cones for reinforcement. Two tails are attached to the back corners of the kite for stability.

The semi-rigid foam-like material of which this kite is formed, although flexible, is less likely to be damaged by high winds than more fragile wood, paper, or plastic materials. The material is also light in weight, which permits the kite to be carried by the wind while being less likely to bend or break. Thus, a kite constructed in accordance with the teachings of the present invention can be used for a much longer period of time than kites of the types disclosed in the prior-art. A kite in accordance with the present invention has the further advantage of being more stable than prior-art kites. The principal advantage of the present invention is, therefore, the combination of greater lift and greater stability in one kite. The kite of the present invention, by the use of frusto-conical openings in the sides of the air pockets, and the semi-rigid material, is deemed to be a substantial improvement over kites of the prior-art, being designed for significant improvements in lift and stability.

Other details will be apparent from a detailed study of the specification hereinafter with reference to the attached drawings.

DETAILED DESCRIPTION OF THE INVENTION

Figure 2:
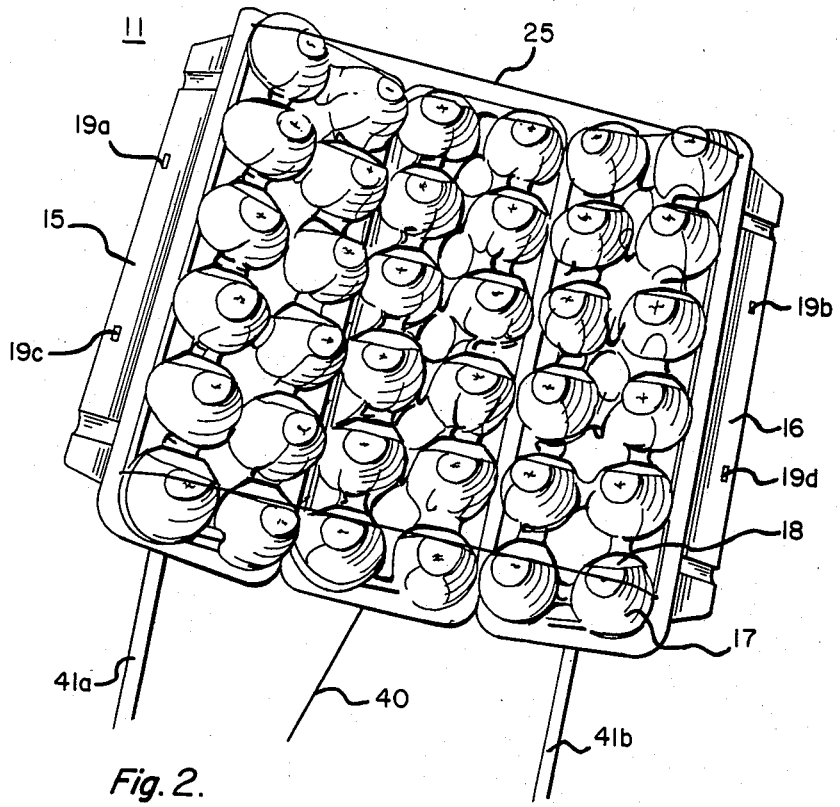
FIG. 2 is a perspective view from the top of the front end of the kite.
Figure 3:
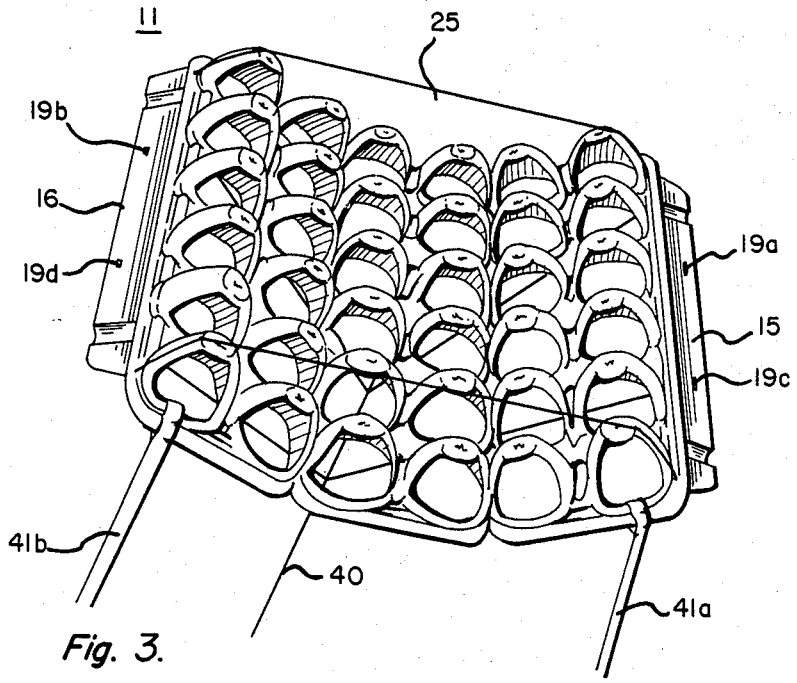
FIG. 3 is a perspective view from the top of the rear end of the kite.
Figure 4:
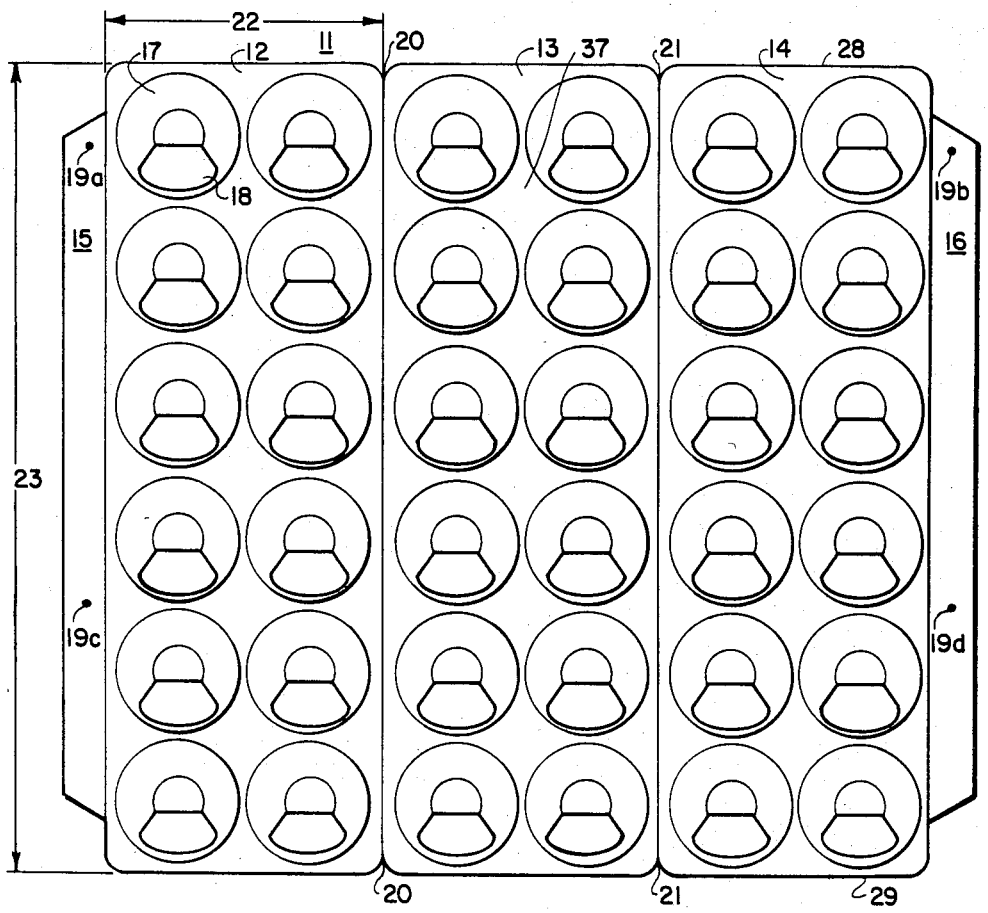
FIG. 4 is a plan view of the upper surface of the kite.
Figure 5:
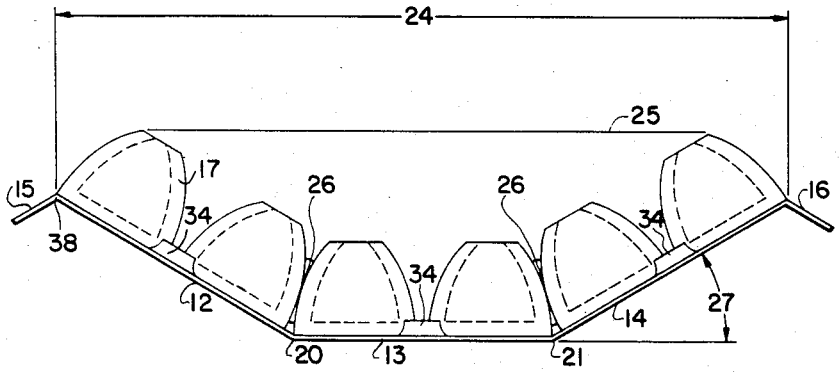
FIG. 5 is an end elevation of the structure shown in FIG. 4.
Figure 6:
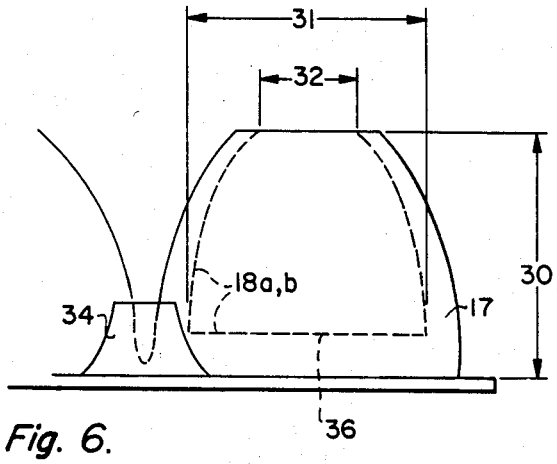
FIG. 6 is a plan view of a single one of the frustoconical cones shown in the kite of the previous figures.
Figure 7:
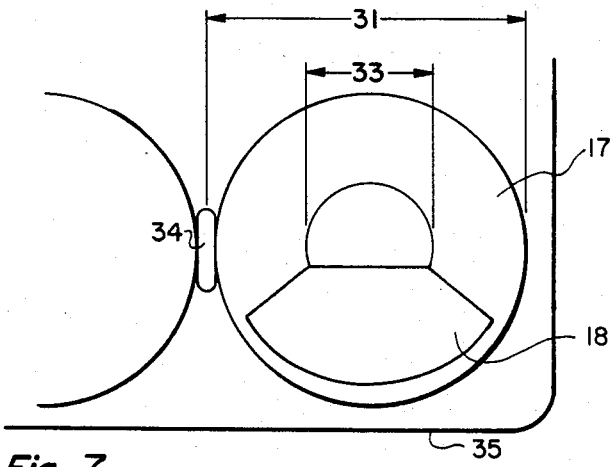
FIG. 7 is a front elevational view of the frustoconical cone of FIG. 6, showing the cutout in the sidewall.

The rigid multi-cone kite 11, as shown from below in FIG. 1 and from above, front and rear, in FIGS. 2 and 3, hereinafter referred to as the cone kite, is made of a lightweight but rigid substance, such as, for example, polystyrene foam plastic. As shown in FIGS. 4 and 5, the entire kite 11 is made up of the three sections 12, 13 and 14, which in the present example, are of die-stamped polystyrene foam, 1.5 millimeters or less in thickness. The width 22 of each section of this embodiment measures 10.5 centimeters, and the length 23 measures 30 centimeters, and consists of six frustoconical protrusions arranged in rows of two cones down the length of the section. Referring to FIGS. 6 and 7, which show individual cones 17 in plan view and side section, each cone measures 5 centimeters in diameter 31 across the base and rises 4 centimeters from the upper face of the section to a height 30, forming a slightly flattened apex two centimeters, in diameter. The centers of the adjacent cones 17 are about 5.5 centimeters apart.

As shown in FIGS. 4 and 5, the three sections 12, 13 and 14 of the kite 11 are joined by a bonding strip of quick-bonding cyanoacrylate glue about 30 centimeters long and about 2 centimeters wide, and of minimal thickness, so that each of the long sides of each section base is connected along junctions 20 and 21. When the sections 12 and 14 are bent inwardly toward center section 13, cones adjacent to junctions 20 and 21 touch at points 26. Because the sections 12, 13 and 14 are in such proximity, glue is applied where the bases of the sections touch along junctions 20 and 21, as well as at points 26 where the cones touch.

In accordance with a preferred embodiment, as shown in FIG. 5, the cone kite 11, when joined in the above manner, has a bowed appearance so that when resting on the underside, the lateral sections 12 and 14 each form an external angle of about 30 degrees 27, with the bases of the central section 13. The dimensions of the kite, after bowing by having lateral sections 12 and 14 bent inwardly, are 28 centimeters in width 24, and 30 centimeters in length 23. As shown in FIGS. 4 and 5, attached along the outer opposite edges and running the length of each lateral section 12 and 14, is a pair of die-stamped flanges 15 and 16, each 25 centimeters long. Each flange is folded at the intersection with the edges of lateral sides 12 and 14 to form a die-stamped hinge 38, thus forming, in each case, a variable external angle with the principal plane of the section. As shown in FIG. 4, each flange 15 and 16 has two perforations 19*a*, 19*b*, and 19*c* and 19*d*, one pair of perforations 19*a* and 19*b* being one centimeter from the front end 28, and one centimeter from the long edge, and another pair 19*c* and 19*d* being 20 centimeters from the front end 28 and one centimeter from the long edge. The perforations 19*a*, 19*b*, 19*c* and 19*d* can be die-stamped or cut out by hand. Each perforation may be reinforced with a quick-bonding glue around its edges.

As shown in FIG. 5, as a means of reinforcing the bow of the kite 11, a string 25 is glued across the tops and down the sides of the corner cones 17. These strings which may, for example, be any type of conventional cotton cord, should be sufficiently taut as to maintain the natural bow of the kite 11.

As shown in the overall view of FIG. 4, and the detailed view in FIG. 6, when viewed from the top or cone surface, the lower one-third of each cone 17 is seen to have a cut-away portion 18 so as to allow air to pass through. As shown in FIG. 4, the interstices 37 of adjacent cones 17 are diamond-shaped. As shown in FIGS. 5, 6, and 7, a pinched projection 34 which may be elliptical in outline, extending slightly above the lower edge of cutout 18 in height, is created on the bottom side of the surface between each of the cones 17 where the cones touch. These rounded pinched projections function aerodynamically.

Referring to FIG. 7, the lower edge 36 of the cutout area 18, which in a preferred embodiment, is 5 centimeters across 31, and comprises an arc of about 108 degrees, is located about 0.8 centimeters above and parallel to the base of the cone 17. Referring also to FIG. 6, the lower edge 36 of cutout 18 is bounded on each side by a slightly curved side edge 18, 18*a*, 18*b* which, at its upper end intersects the edge of the apex area 33, the length 32, of which is 1.8 centimeters. The cutouts or air vents 18 can also be formed during the stamping process or cut out later by hand.

Referring again to FIG. 1, two bridle strings 39*a*, 39*b* are attached to the flanges 15 and 16 through the four perforations 19*a*, 19*b*, 19*c* and 19*d*. Quick-bonding glue around the edges of the four perforations 19*a*, 19*b*, 19*c* and 19*d* prevents the bridle strings 39*a*, 39*b* from cutting through the polystyrene foam. In accordance with a preferred embodiment, the bridles 39*a*, 39*b* may be of conventional cotton kite string and are attached to the underside of the kite 11 through the holes 19*a*, 19*b*, 19*c* and 19*d* in the flanges 15 and 16. One bridle 39*a* is 42.5 centimeters long and is secured to the two front holes 19*a*, 19*b*, and another is 45 centimeters long and is attached to the two back holes 19*c*, 19*d*. A tether 40 is tied to both strings 39*a* and 39*b* so that it can be adjusted by sliding from side-to-side for centering. The kite should have a tether 40 long enough to enable optimum lift by the wind currents. In the present embodiment, the tether is preferably about 12 meters in length, and is made of material strong enough, such as, conventional twine or kite string, to enable the kite to be returned to the ground when its use is completed. Two tails 41*a*, 41*b* of equal length are attached to the back corners 29 and 35 of the kite for stability. A suggested length is 60 centimeters or more as needed.

The kite of the present invention can be die-stamped in three sections 12, 13 and 14 which are later joined; or alternatively, it can be stamped as one unit 11 whose sections need to be bent to the proper angles 27. The dimensions of the kite can be increased by increasing the number of cones 17 on each section 12, 13 and 14. Increased dimensions may necessitate an increase in the thickness of the polystyrene material.

A particular advantage of the kite of the present invention is that it is aerodynamically suited to provide greater lift than kites of the prior art, having significantly more stability of structure through the use of conical air pockets and polystyrene plastic.

The kite of the present invention is best operated in an outside area with few trees, and should be flown in fair weather when there are moderately strong winds. It is contemplated that the kite of the present invention will also be flown with the base of the frustoconical members and the bridle strings and tether facing the ground.

Although by way of illustration the present invention has been described with reference to a particular embodiment, it will be understood that the invention is not limited to the specific structures or dimensions disclosed, but only by the scope of the appended claims.

What is claimed is:

1. A lite comprising in combination three substantially identical rectangular sections of foam-like material comprising in combination:

a central section;

a pair of symmetrically disposed lateral sections contiguous with and extended along opposite edges and said central section, said lateral sections each being bent inwardly along said junctions at oppositely directed substantially equal internal angles and forming substantially equal external angles with the underside of the central section;

each of said sections comprising on its upper surface a plurality of rows of adjacent, hollow, substantially frustoconical members protruding from substantially circular concentric openings at the base of each of said members, a substantially identical portion of the sidewall of each of said frustoconical members being cut out to form an aerodynamical cup.

2. The combination in accordance with claim 1 wherein at least one tail is appended to said kite.

3. The combination in acxordance with claim 1 in which the foam-like material consists essentially of polystyrene plastic.

4. The combination in accordance with claim 1 in which said substantially equal external angles are each about 30 degrees.

5. The combination in accordance with claim 1 wherein appended to each of said symmetrically disposed lateral sections is a laterally extended flange with front and rear perforations, said flange appended by means of a die-stamped hinge, whereby said flange is constructed and arranged to move independently of said sections.

6. The combination in accordance with claim 5 wherein a pair of front and rear bridles pass through said front and rear perforations in said flange.

7. The combination in accordance with claim 6 wherein appended to said bridles is a tether, said tether capable of movement from side-to-side for centering of said kite.

8. The combination in accordance with claim 1 in which the overall dimension of said frustoconical members is approximately two and one-half to three times as long at the base as at the apex.

9. The combination in accordance with claim 1 in which the lower edge of each of said sidewall cut-outs is disposed about one-fifth of the height of said frustoconical members above the surface of said sections and runs parallel to the base of the frustoconical member.

* * * * *